United States Patent [19]

Dowse

[11] 3,996,715

[45] Dec. 14, 1976

[54] BUILDING BLOCKS

[75] Inventor: Brian Edward Wesley Dowse, Reading, England

[73] Assignee: Golder Hoek and Associates Limited, Maidenhead, England

[22] Filed: Nov. 24, 1975

[21] Appl. No.: 634,841

[30] Foreign Application Priority Data

Dec. 18, 1975 United Kingdom ..... 54564/75

[52] U.S. Cl. ..... 52/593; 52/609

[51] Int. Cl.[2] ..... E04C 1/10

[58] Field of Search ..... 52/569, 570, 571, 572, 52/591, 594, 596, 608, 609, 593; 404/34, 40, 41

[56] References Cited

FOREIGN PATENTS OR APPLICATIONS

| | | | |
|---|---|---|---|
| 1,658,549 | 2/1970 | Germany | 404/41 |
| 267,895 | 7/1950 | Switzerland | 404/34 |

*Primary Examiner*—John E. Murtagh

[57] ABSTRACT

A one piece building block suitable for load bearing applications such as road surfaces and river linings. The block includes an upper hexagonal portion and a lower portion having load bearing projections which, when the block is viewed in plan, project outwardly from alternate sides of the upper portion. Each projection extends substantially the entire length of its respective side. The lower portion has recesses of shape complementary with that of the projections to enable a plurality of identical blocks to be interlocked.

1 Claim, 4 Drawing Figures

BUILDING BLOCKS

This invention relates to a structural building unit or block particularly suitable for constructing load bearing roadway or airfield pavements and canal or river linings.

According to the invention, there is provided a one piece building block comprising an upper portion of generally hexagonal cross-section and a lower portion providing load bearing projections which when the block is viewed in top plan project outwardly from alternate sides of the upper portion, each projection extending substantially the entire length of its respective side, the lower portion providing recesses of shape complementary with that of the projections to enable a plurality of identical blocks to be interlocked.

Figure 1:
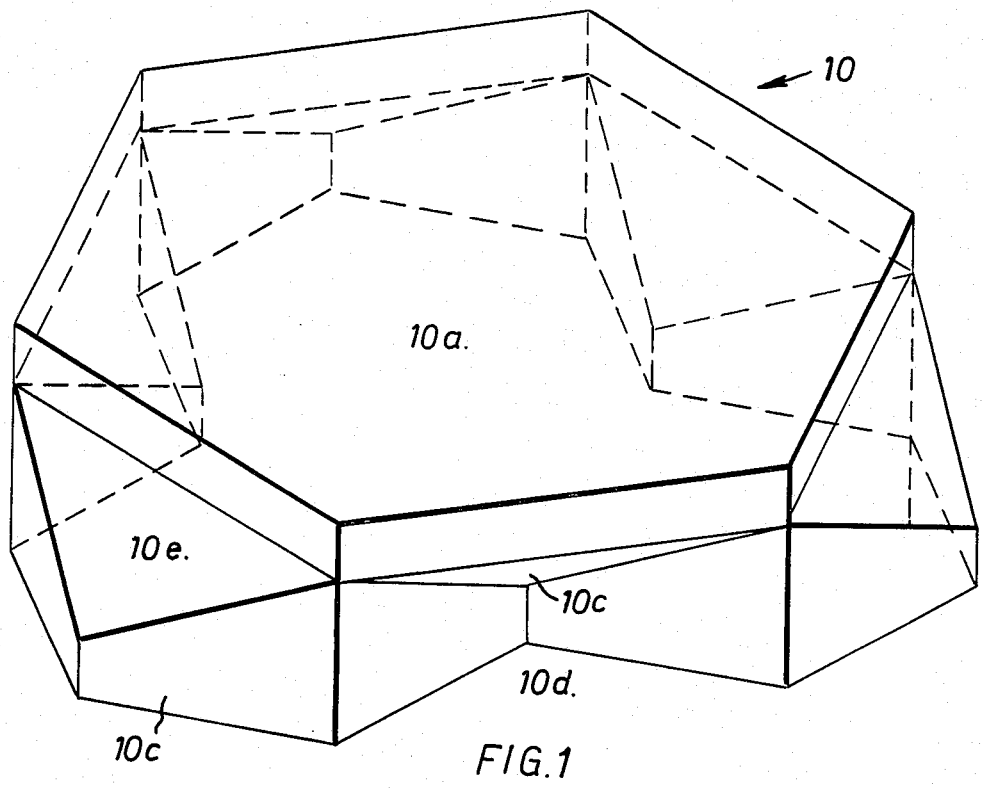
Figure 3:
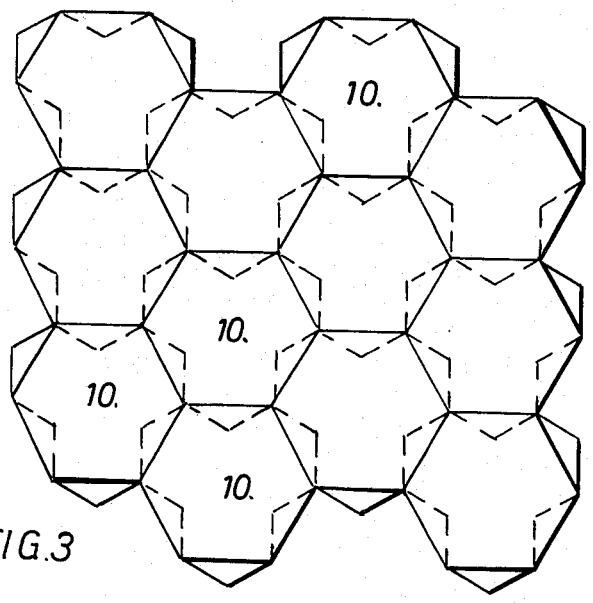
Figure 2:
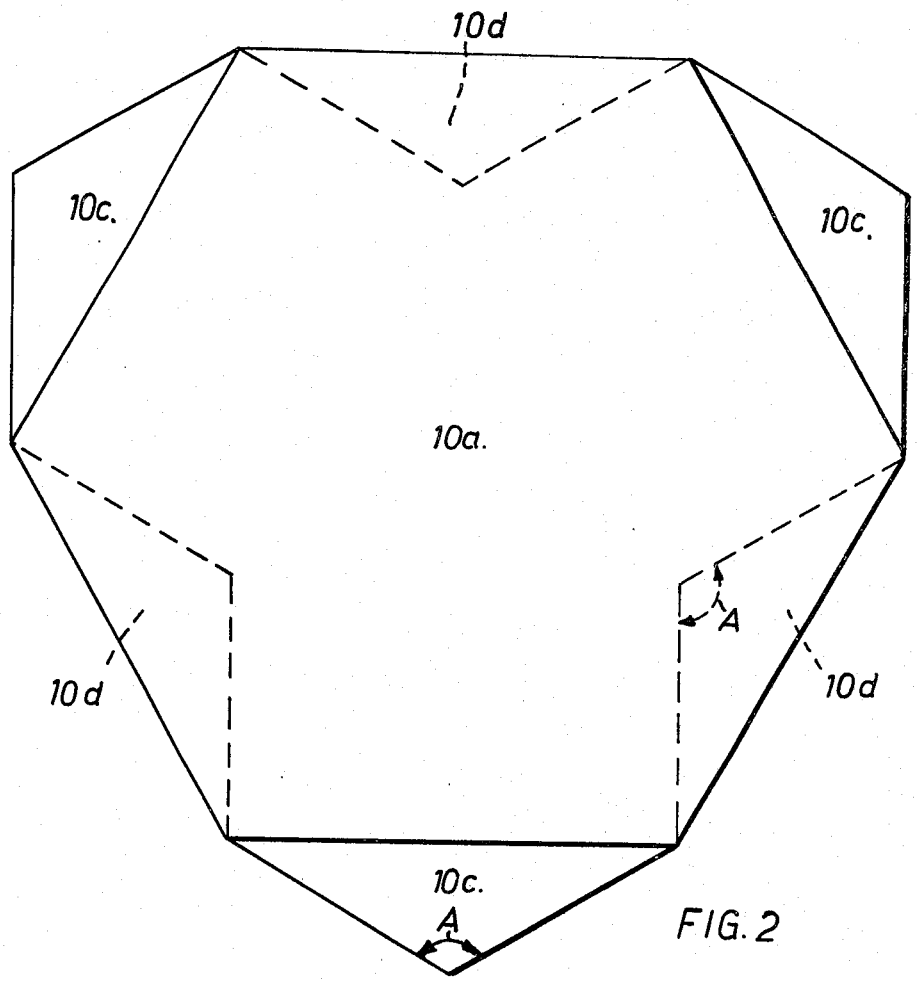
Figure 4:
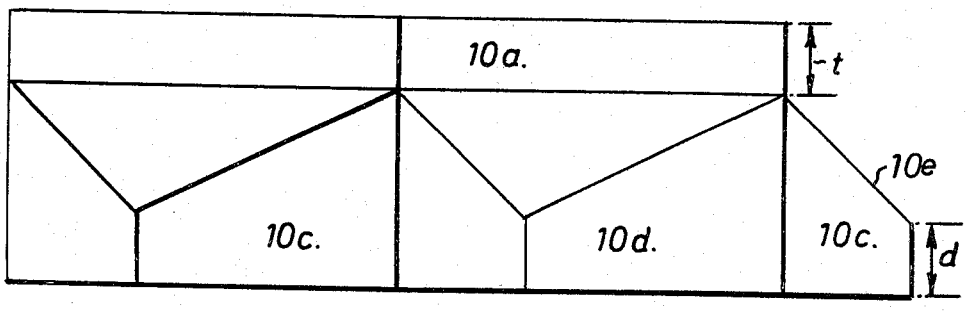

An embodiment of the invention will now be described by way of example only with reference to the accompanying drawings, in which:

FIG. 1 is an isometric view of a structural building block according to the invention, FIG. 2 is a plan view of the block of FIG. 1, FIG. 3 is a plan view of a plurality of the blocks of FIG. 1 shown in interlocking relationship, and FIG. 4 is a side view of the block of FIG. 1.

Referring to the drawings, the structural building block 10 consists of a one-piece body most probably cast from concrete, or from a clay which is then fired. The body comprises an upper portion 10*a* of generally hexagonal cross-section, and a lower portion 10*b* providing load bearing projections 10*c* which when the block is viewed in top plan (FIG. 2) project outwardly from alternate sides of the upper portion; each projection extends the full length of its respective side. The lower portion is provided with recesses of shape complementary with that of the projections to enable interlocking of a plurality of identical blocks. When viewed in plan the projections and recesses have an overall triangular shape. The triangular projections and recesses have an apex angle A which is preferably 120° and an upper surface 10*e* which slopes downwardly relative to the top surface of the block at an angle preferably of 45°. In the preferred shape of the block, the apex of each surface 10*e* is spaced above the base of the block by a distance *d* equal to the thickness *t* of the upper portion 10*a*. It will be apparent from a reference to FIG. 2 that the base surface of the preferred shape of block will have a three lobed overall shape as would be formed by three identical and touching hexagonal figures. Conveniently, the upper and base surfaces of the block will be planar and parallel to each other.

FIG. 3 shows a plurality of the above described blocks assembled together in interlocking relationship to form a pavement or canal lining, the projections of each block fitting closely within the recesses of adjacent blocks to effectively key each block to the other blocks in the wall.

Advantages of an interlocking structure formed from the above described blocks are (1) it is able to withstand a large load since the integrally formed projections of each block provide a large shear area. (2) it is self-levelling due to the interlocking relationship of the blocks, and (3) it provides a structure in which each block is firmly supported on its projections at three equally spaced locations, and in which each block is firmly locked against substantial movement in either of opposite vertical directions.

The blocks are particularly suited for use in constructing canal or river linings or for use as a permanent or temporary load bearing surface such as may be required for municipal and industrial pavements or airfields.

What is claimed is:

1. A one piece building block comprising an upper portion of generally hexagonal cross-section, and a lower portion providing load bearing projections which when the block is viewed in top plan project outwardly from alternate sides of the upper portion, each projection extending substantially the entire length of its respective side, the lower portion providing recesses of shape complementary with that of the projections to enable a plurality of identical blocks to be interlocked, the projections being of triangular shape when viewed in bottom plan, the apex angle of the projections being substantially 120° so that the base surface of the block is effectively formed by three identical and touching hexagons, each projection when viewed from the side having a top surface inclined at approximately 45° to the top hexagonal surface of the block.

* * * * *